US009677314B2

(12) United States Patent
Houser

(10) Patent No.: US 9,677,314 B2
(45) Date of Patent: Jun. 13, 2017

(54) LIFT GATE SYSTEM AND METHOD OF INSTALLATION THEREOF

(71) Applicant: William Clifford Houser, Stanley, NC (US)

(72) Inventor: William Clifford Houser, Stanley, NC (US)

( * ) Notice: Subject to any disclaimer, the term of this patent is extended or adjusted under 35 U.S.C. 154(b) by 0 days.

(21) Appl. No.: 14/695,853

(22) Filed: Apr. 24, 2015

(65) Prior Publication Data

US 2016/0312512 A1 Oct. 27, 2016

(51) Int. Cl.

| | |
|---|---|
| ***E05D 15/40*** | (2006.01) |
| ***E05F 15/59*** | (2015.01) |
| ***E05D 15/38*** | (2006.01) |
| ***E05F 15/668*** | (2015.01) |
| ***E05D 13/00*** | (2006.01) |

(52) U.S. Cl.

CPC ..... *E05F 15/59* (2015.01); *E05D 13/003* (2013.01); *E05D 13/1215* (2013.01); *E05D 15/38* (2013.01); *E05F 15/668* (2015.01)

(58) Field of Classification Search

CPC .... E05F 15/59; E05D 13/003; E05D 13/1215; E05D 15/38

USPC ..... 49/197, 199, 201, 202, 203

See application file for complete search history.

(56) References Cited

U.S. PATENT DOCUMENTS 1,843,973 A * 2/1932 Dickason ..... E05D 15/445 49/204
1,980,303 A * 11/1934 Thompson ..... E05D 15/38 49/200
2,163,394 A * 6/1939 Clark ..... E05D 15/425 49/204
2,244,642 A * 6/1941 Ferris ..... E05D 15/425 49/206
2,260,080 A * 10/1941 Lane ..... E05F 15/50 172/456
2,330,006 A * 9/1943 Odenthal ..... E05F 15/59 417/291
2,388,182 A * 10/1945 Redding ..... E05F 15/686 318/266
2,440,561 A * 4/1948 Wilder ..... E05F 15/59 49/200
2,533,423 A * 12/1950 Bunch ..... E05F 15/59 49/200

(Continued)

FOREIGN PATENT DOCUMENTS

DE 3819387 A1 * 12/1989 ..... E05D 15/425
EP 0299489 A1 * 1/1989 ..... E05F 15/668

(Continued)

*Primary Examiner* — Jerry Redman

(74) *Attorney, Agent, or Firm* — Grell & Watson Patent Attorneys LLC

(57) ABSTRACT

A lift gate system includes a gate, a first pole, a second pole, a header and an internal operator. The first pole is configured to attach to the ground on one side of the gate and includes a first track attached approximate to a first top. The second pole is configured to attach to the ground on the opposite side of the gate from the first pole and includes a second track attached approximate to a second top. The header interconnects the first top with the second top. The internal operator is configured for lifting the gate, where the internal operator is inside the first pole, the second pole, and/or the header.

15 Claims, 11 Drawing Sheets

(56) References Cited

U.S. PATENT DOCUMENTS

| | | | | | |
|---|---|---|---|---|---|
| 2,641,467 | A * | 6/1953 | Reed | E05F 15/50 | 60/401 |
| 2,657,486 | A | 11/1953 | Sweetser | | |
| 3,468,060 | A * | 9/1969 | Mursinna | E05F 15/59 | 49/200 |
| 3,526,994 | A * | 9/1970 | Delaney | E05F 15/684 | 49/199 |
| 3,704,548 | A * | 12/1972 | Wiegleb | E05F 15/668 | 49/199 |
| 4,417,418 | A * | 11/1983 | Warning | E05F 15/59 | 160/188 |
| 4,442,631 | A * | 4/1984 | Weber | E05F 15/668 | 49/199 |
| 4,765,093 | A * | 8/1988 | Edwards, Jr. | E05D 15/38 | 49/197 |
| 4,819,376 | A * | 4/1989 | Taddei | E05F 15/678 | 49/200 |
| 5,136,810 | A | 8/1992 | DeWitt, III | | |
| 5,146,710 | A | 9/1992 | Caldwell | | |
| 5,239,776 | A * | 8/1993 | Lhotak | E05F 15/668 | 49/199 |
| 5,373,663 | A * | 12/1994 | Turini | E05D 13/145 | 49/200 |
| 5,639,178 | A | 6/1997 | Wilson et al. | | |
| 5,720,132 | A | 2/1998 | Renner et al. | | |
| 5,806,245 | A | 9/1998 | Satrom | | |
| 7,219,711 | B2 * | 5/2007 | Keller | E05D 15/264 | 160/188 |
| 8,245,446 | B2 * | 8/2012 | Betker | E05D 15/38 | 49/197 |
| 9,045,928 | B1 * | 6/2015 | Seitz | E05F 15/59 | |
| 9,091,107 | B2 * | 7/2015 | Betker | E05D 15/38 | |
| 9,273,507 | B2 * | 3/2016 | Petrat | E05F 15/53 | |
| 2002/0029524 | A1 * | 3/2002 | Kerkvliet | E05D 11/00 | 49/200 |
| 2008/0086947 | A1 * | 4/2008 | Crown | E05F 15/51 | 49/199 |
| 2009/0260293 | A1 | 10/2009 | Lough | | |
| 2015/0368950 | A1 * | 12/2015 | Baczweski | E05D 15/445 | 49/200 |

FOREIGN PATENT DOCUMENTS

| | | | | |
|---|---|---|---|---|
| FR | 2588908 | A1 * | 4/1987 | E05D 15/401 |
| FR | 2708964 | A1 * | 2/1995 | E05D 15/38 |
| GB | 812284 | A * | 4/1959 | E05D 15/38 |
| IT | FR 2311488 | A7 * | 12/1976 | E05F 15/59 |

* cited by examiner

LIFT GATE SYSTEM AND METHOD OF INSTALLATION THEREOF

BACKGROUND

Technical Field of the Disclosure

The instant disclosure relates to gates and gate systems, like for use in the entrance and/or exit of parking garages. More particularly, the instant disclosure relates to a lift gate system for use in the entrance and/or exit of parking garages or like structures.

Description of the Related Art

Gates, like tilt gates, are often installed in the entrances and/or exits of parking garages or other like structures. Lift gates include a flat panel that tilts as they're lifted upwards to rest flat overhead or near the ceiling. The typical lifting system includes an overhead operator with a motor that drives an arm for lifting the gate. Overhead gate openers are generally commercially used in underground parking garages where space is at a premium. They lift the gate overhead very similar to a typical garage door opener. In this instance the gate may weigh much more than a residential garage door, thus, the operator and hardware are built much heavier to accommodate these loads.

As parking garages have various size openings for the entrance and/or exit, gates and the systems they operate on typically need to be custom designed to fit the desired entrance/exit opening with the desired operating features required or desired by the owner. One problem that has been discovered is the time, effort, and training it takes to install current gates and their lift systems. For example, in addition to the time it takes for the pre-work of designing the gate and the lift system and features, a standard install of a tilt gate and lift system with standard operating features by experienced installers can take a weeks worth of time and effort or more to install. As a result, the entrances and exits are either unusable and/or not secured for an undesired lengthy period of time. As one should readily understand, it is clearly desirable to shorten the length of time it takes to install and make the installation of the gates and lifting systems easier.

Another problem that has been discovered is the danger associated with installing current gates and lift systems. The current standard systems have a spring loaded arm assembly to reduce the force required to raise the gate. This spring loaded arm assembly is very difficult to initially install onto the gate, as the gate is often times too heavy to be manually lifted. As such, the spring loaded arm assembly has to be stretched down to reach the gate. This process is very difficult and has been discovered to lead to damage of parts and/or injury to the installers. As such, it is clearly desirable to provide a lift gate system that is easier and safer to install.

Another problem that has been discovered with current lift gate systems is the difficulty in aligning the tracks squarely with the gates. The alignment of the tracks is important for operating the lift gate system properly and/or efficiently. As such, it is clearly desirable to provide a lift gate system that is easier to align the tracks.

Another problem that has been discovered with current lift gate systems is that, to conceal the operator inside the parking garage to prevent tampering and unauthorized access (i.e. the operator must be positioned on the inside of the parking garage), the gate must be lifted out towards the outside to open. This forces the gate to open in the same direction for both the entrance and the exit. As a result, extra clearance must be provided before or after the gate to allow the gate to open and close. Thus, it is desirable to provide a lift gate system that can open the gate in either direction, while still concealing the operator from the outside.

The instant disclosure provides a lift gate system that is designed to address at least certain aspects of the problems discussed above.

SUMMARY

Briefly described, in a preferred embodiment, the present apparatus and method overcomes the above-mentioned disadvantages and meets the recognized need for such a device by providing a lift gate system that is easy and safe to install.

The present lift gate system and method includes a gate, a first pole, a second pole, a header and an internal operator. The first pole is configured to attach to the ground on one side of the gate and includes a first track attached approximate to a first top. The second pole is configured to attach to the ground on the opposite side of the gate from the first pole and includes a second track attached approximate to a second top. The header interconnects the first top with the second top. The internal operator is configured for lifting the gate, where the internal operator is inside the first pole, the second pole, and/or the header.

In select embodiments, the internal operator may be a hydraulic operator, a pneumatic operator, and/or an electric operator.

In select embodiments, the internal operator may be a hydraulic operator. The hydraulic operator may include at least one hydraulic cylinder configured to lengthen and shorten for raising and lowering the gate. In select embodiments, the hydraulic operator may further include a rotatable mount on a fixed end of the hydraulic cylinder, and a lever assembly on an extendable end of the hydraulic cylinder connected to the gate. The lever assembly may include a first lever, a second lever, and a shaft held in place by pillow block bearings. Wherein, the first lever may be pivotally connected to the extendable end of the hydraulic cylinder at one end and fixed to one end of the shaft, and the second lever may be pivotally connected to the gate at one end and fixed to the other end of the shaft. Whereby, rotation of the first lever by the hydraulic cylinder may cause rotation of the second lever thereby raising or lowering the gate.

In select embodiments, the lever assembly may further include a compression spring mounted on a lengthened end of the first lever opposite the extendable end of the hydraulic cylinder. The compression spring may bias the first lever to put an upward force on the gate via the second lever and the shaft.

One feature may be that the compression spring can be adjustable by including a threaded shock absorber body, a shock absorber rod and a compression nut. The threaded shock absorber body may be pivotally mounted. The shock absorber rod may extend from the threaded shock absorber body and may terminate at a spring site. The compression nut may be on the shock absorber body for adjusting the force of the compression spring on the first lever via the spring site.

Another feature may be that the second lever can include an angle iron releasably connected to a flat bar pivotally attached to the gate, wherein the angle iron may be disconnected from the flat bar for manually operating the gate.

Another feature may be that the shaft can be keyed at one or both ends for disengaging the first lever and/or the second lever from the shaft for manually operating the gate.

In select embodiments, the hydraulic operator may include a fluid reservoir and a pump. The pump may interconnect with the fluid reservoir and the hydraulic cylinder and may control fluid moving between the fluid reservoir and the hydraulic cylinder for lengthening and shortening the hydraulic cylinder. An intake line may be included for interconnecting the reservoir with the pump. A pressure line may be included for interconnecting an inlet of the hydraulic cylinder with the fluid pump. A return line may be included for interconnecting an outlet of the hydraulic cylinder with the reservoir.

Another feature of the hydraulic operator may be a four way valve between the pressure line and the return line for controlling flow.

Another feature of the hydraulic operator may be an inlet two way check valve at the inlet of the hydraulic cylinder, and/or an outlet two way check valve at the outlet of the hydraulic cylinder.

In select embodiments, the hydraulic operator may have two hydraulic cylinders. In these embodiments, a pressure flow divider may be included in the pressure line for connecting a second inlet of the second hydraulic cylinder, and a return flow divider may be included in the return line for connecting a second outlet of the second hydraulic cylinder. Wherein, the first hydraulic cylinder may be in the first post and the second hydraulic cylinder may be in the second post, or vice versa.

One feature of the lift gate system may be that each of the first and second tracks can include a protrusion from a bottom of each of the tracks along a length of each track. A guide wheel for each track may have a notch adapted to receive the protrusion. Whereby, the protrusion may maintain the wheel in the center of the track as the wheel rides along the length of the track over the protrusion.

Another feature may be that each of the first and second tracks may include a tension spring configured to bias the gate open. Each tension spring may include an adjustment bolt for adjusting the distance from the terminal end of each track thereby adjusting the tension in each tension spring.

Another feature may be that each of the first and second poles may include a flange adapted to attach each pole to an anchor in the ground.

In select embodiments of the lift gate system, the internal operator may include a motor and a gear assembly linked to the motor and connected to the gate. The gear assembly may include a motor gear, an idle gear, and a gate arm. The motor gear may be connected to the motor. The idle gear may be in communication with the motor gear and may have an idle shaft held in place with pillow block bearings. The gate arm may be connected to the idle shaft on one end and the gate on the other end. Whereby, rotation of the motor turns the gear assembly for raising and lowering the gate.

In select embodiments of the lift gate system, the hydraulic operator may include a fixed mount with a slot assembly. The fixed mount may be on the fixed end of the hydraulic cylinder. The slot assembly may be on the extendable end of the hydraulic cylinder and may be connected to the gate. The slot assembly may include a pivot shaft on the extendable end of the hydraulic cylinder going through a slot in the pole and connecting with the gate by a pillow block bearing. Wherein, the tracks may include a first angled portion for initiating the raising of the gate. Whereby, raising and lowering of the extendable end of the hydraulic cylinder may cause raising or lowering of the gate.

In use, a method of installing a lift gate system may be carried out with any of the embodiments of the lift gate system shown and/or described herein. In general the method of installing the lift gate system may include the steps of: providing the lift gate system in any of the various embodiments shown and/or described herein; and attaching the first pole and the second pole to the ground in a desired location.

In select embodiments of the method of installing the lift gate system, where the first and second poles include a flange adapted to attach each pole to an anchor in the ground, the step of attaching the first pole and the second pole to the ground in a desired location may include the steps of: installing the anchors in a desired location for the first and second poles; and attaching the flanges of the first and second poles to the corresponding anchors.

BRIEF DESCRIPTION OF THE DRAWINGS

The present lift gate system will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1A:
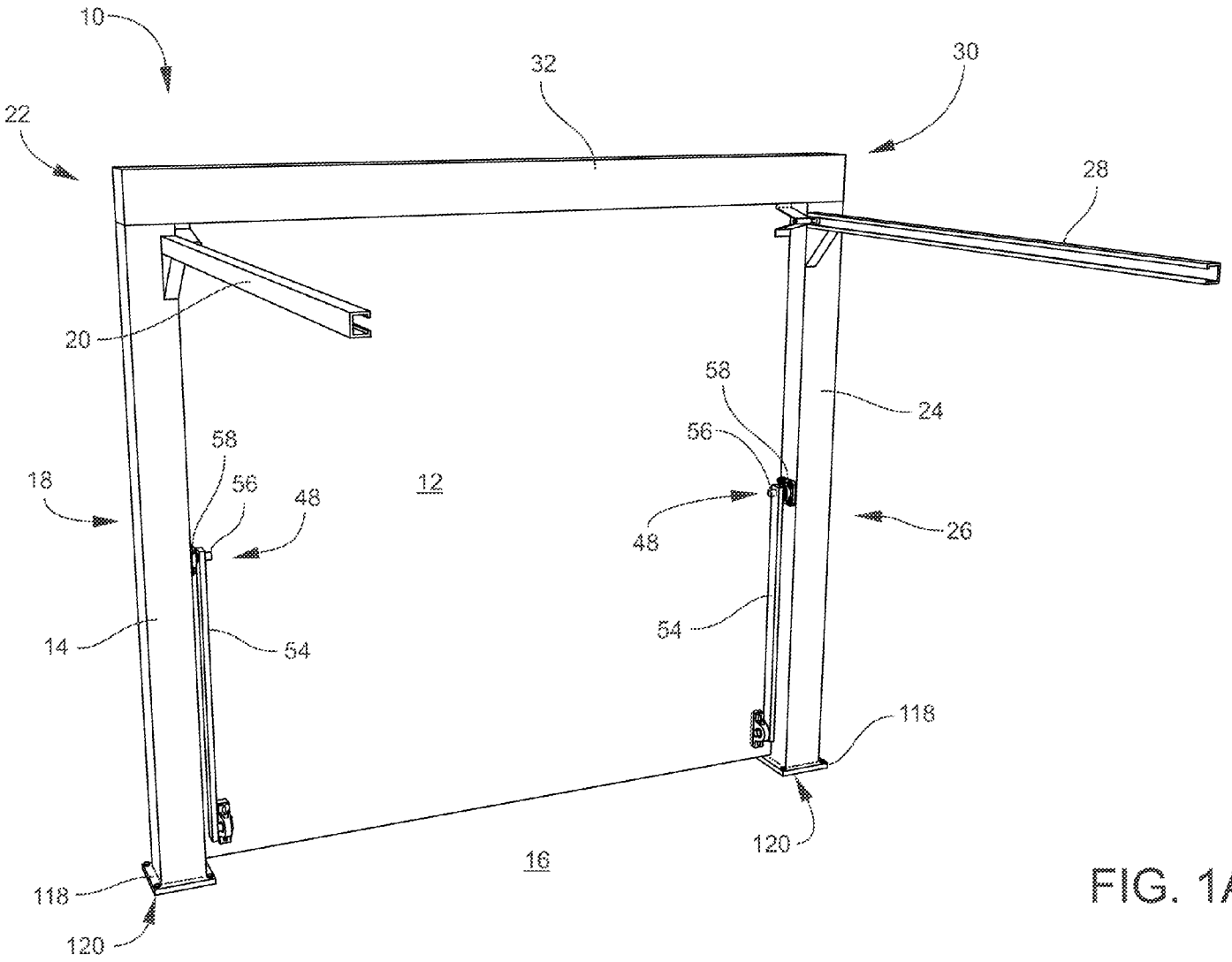
FIG. 1A is a perspective view of an exemplary embodiment of the lift gate system in a closed position.
Figure 1B:
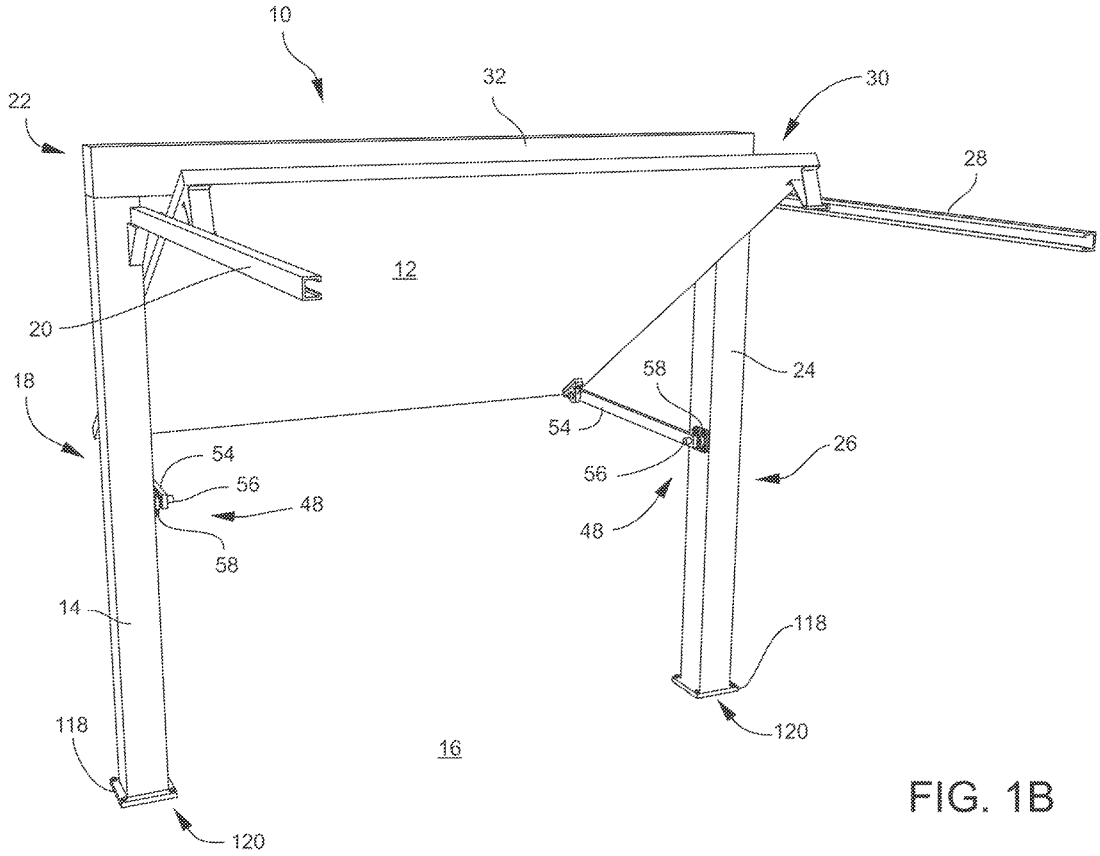
FIG. 1B is a perspective view of the lift gate system from FIG. 1A in an intermediate position.
Figure 1C:
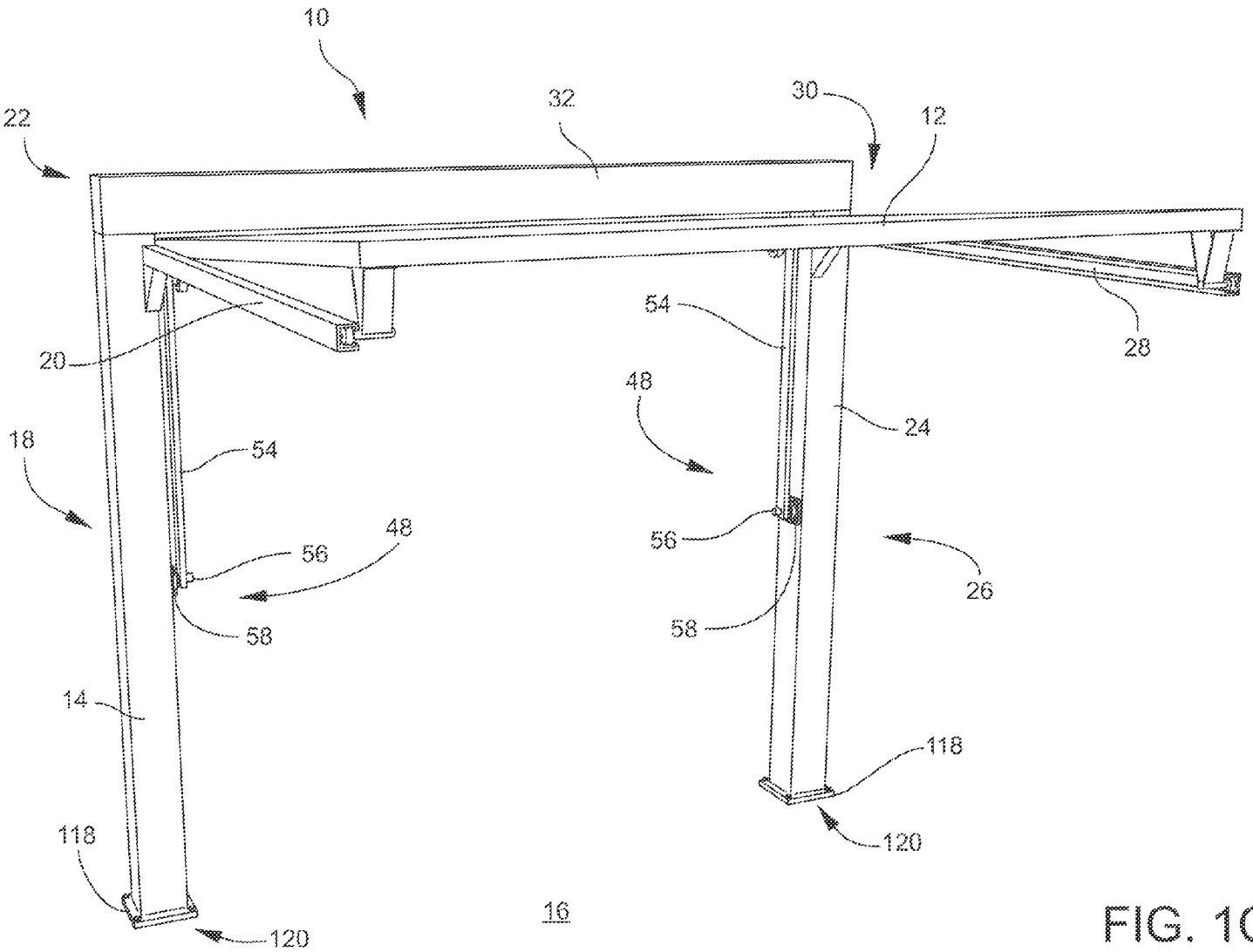
FIG. 1C is a perspective view of the lift gate system from FIG. 1A in an open position.

Referring now to FIGS. 1A-1C by way of example, and not limitation, therein is illustrated example embodiments of lift gate system 10 in a closed position (FIG. 1A), an intermediate position (FIG. 1B), and an open position (FIG. 1C). Lift gate system 10 may provide a system that is easy and safe to install, has tracks that are pre-aligned, and can open in either direction while concealing the operator. As shown therein, lift gate system 10 generally comprises gate 12, first pole 14, second pole 24, header 32 and internal operator 34.

As shown in FIGS. 1A-1C, first pole 14 may be configured to attach to the ground 16 on one side 18 of the gate 12 and may include the first track 20 attached approximate to the first top 22 of first pole 14. Likewise, the second pole 24 may be configured to attach to the ground 16 on the opposite side 26 of the gate 12 from the first pole 14 and may include the second track 28 attached approximate to the second top 30. The header 32 may interconnect the first top 22 of first pole 14 with the second top 30 of second pole 24. The first pole 14, second pole 24, and header 32 may be hollow or partially hollow for housing the internal operator 34. For example, and clearly not limited thereto, first pole 14 and second pole 24 may be square 6 inch by 6 inch steel poles. As another example, if the lift gate system is installed in line with 2 gates (i.e. an entrance and exit or two entrances/exits), a single center pole may be used, like a square 12 inch by 12 inch steel pole between the two first and second poles 14 and 24. This center pole may house 2 internal operators for operating both gates. There may be no limit to the overall size of tubing needed for the gate posts. With the instant disclosure, the center post may house 2 cylinders and may be a 12 inch square post. For example, the center post may be used when 2 gates are required, like one exit and one entrance, side by side in a straight line.

Figure 8:
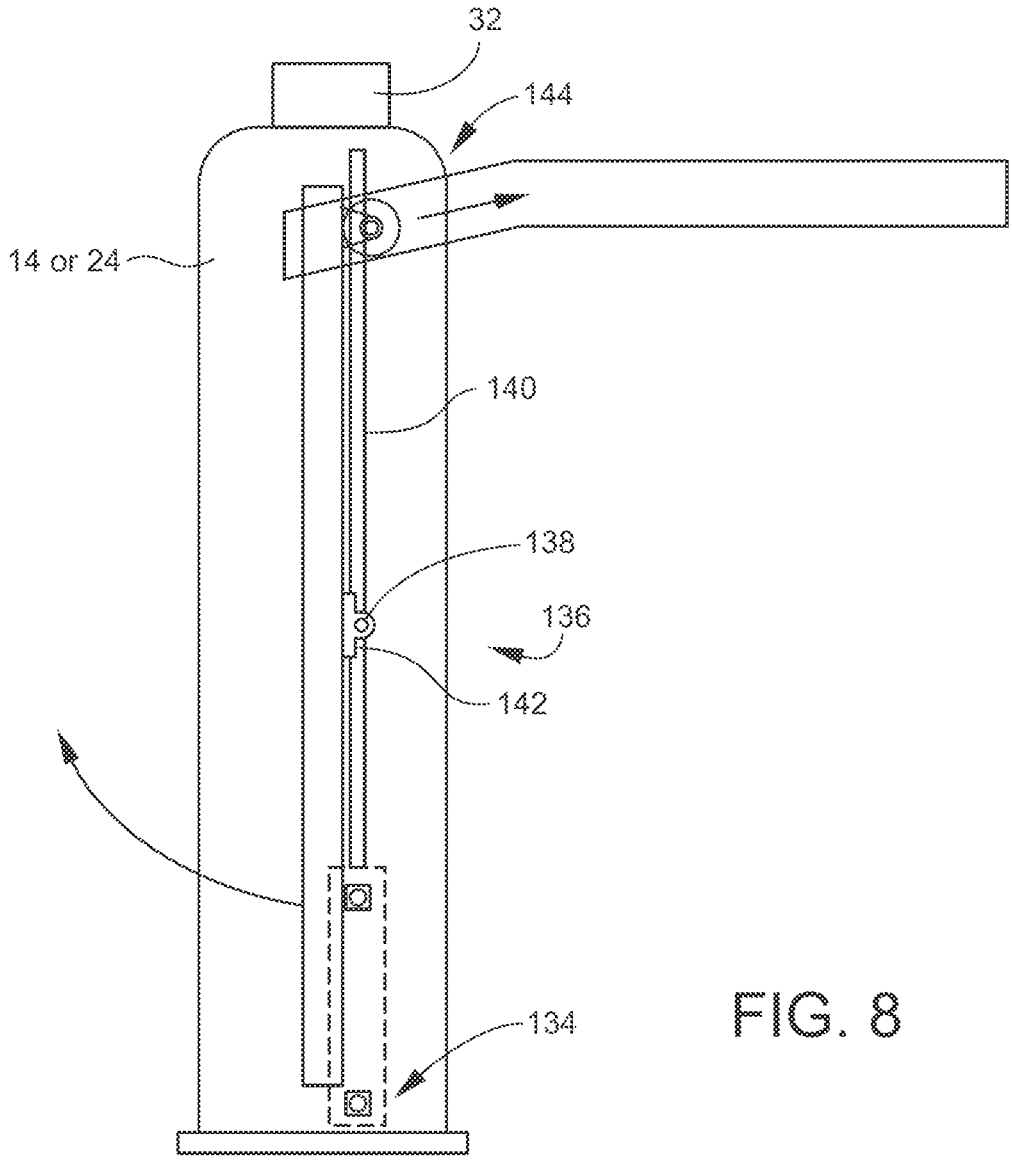
FIG. 8 is a partial broken away side view of an exemplary embodiment of one of the post with an exemplary embodiment of the slot assembly.

The internal operator 34 may be configured for lifting the gate 12. Internal operator 34 may be positioned internally inside lift gate system 10, including any position or positions inside lift gate system 10. As examples, internal operator 34 may be inside the first pole 14, the second pole 24, and/or the header 32. Internal operator 34 may be any desired operator with any desired motor or power for lifting gate 12 that is internal to lift gate system 10. For example, and clearly not limited thereto, internal operator 34 may be the hydraulic operator 36 (as shown in FIGS. 2-3 and 8, and discussed in detail below), a pneumatic operator, an electric operator, the like, and/or combinations thereof.

Figure 2:
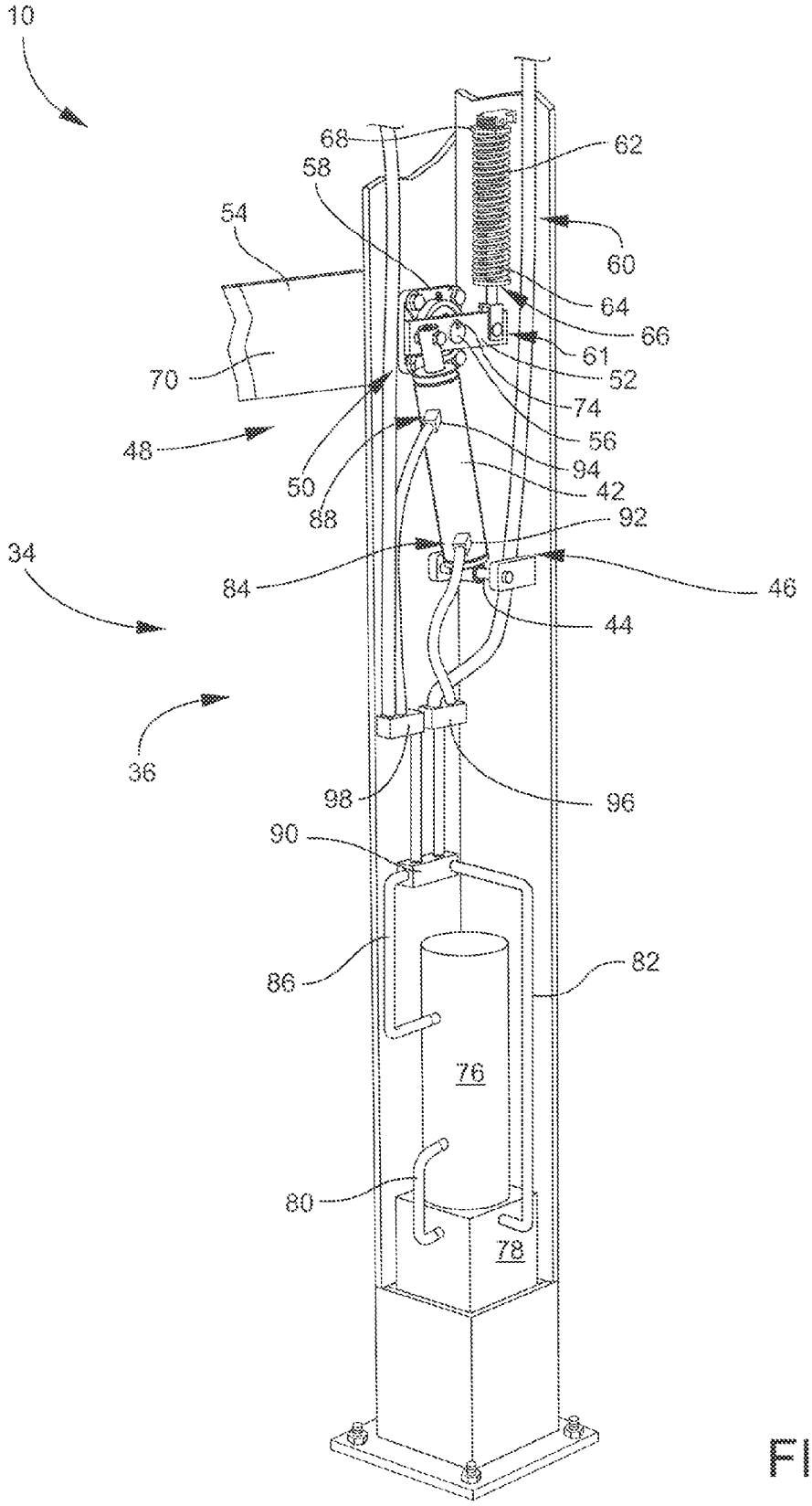
FIG. 2 is a partial broken away perspective view of an exemplary embodiment of the post with an exemplary embodiment of the internal operator.
Figure 3A:
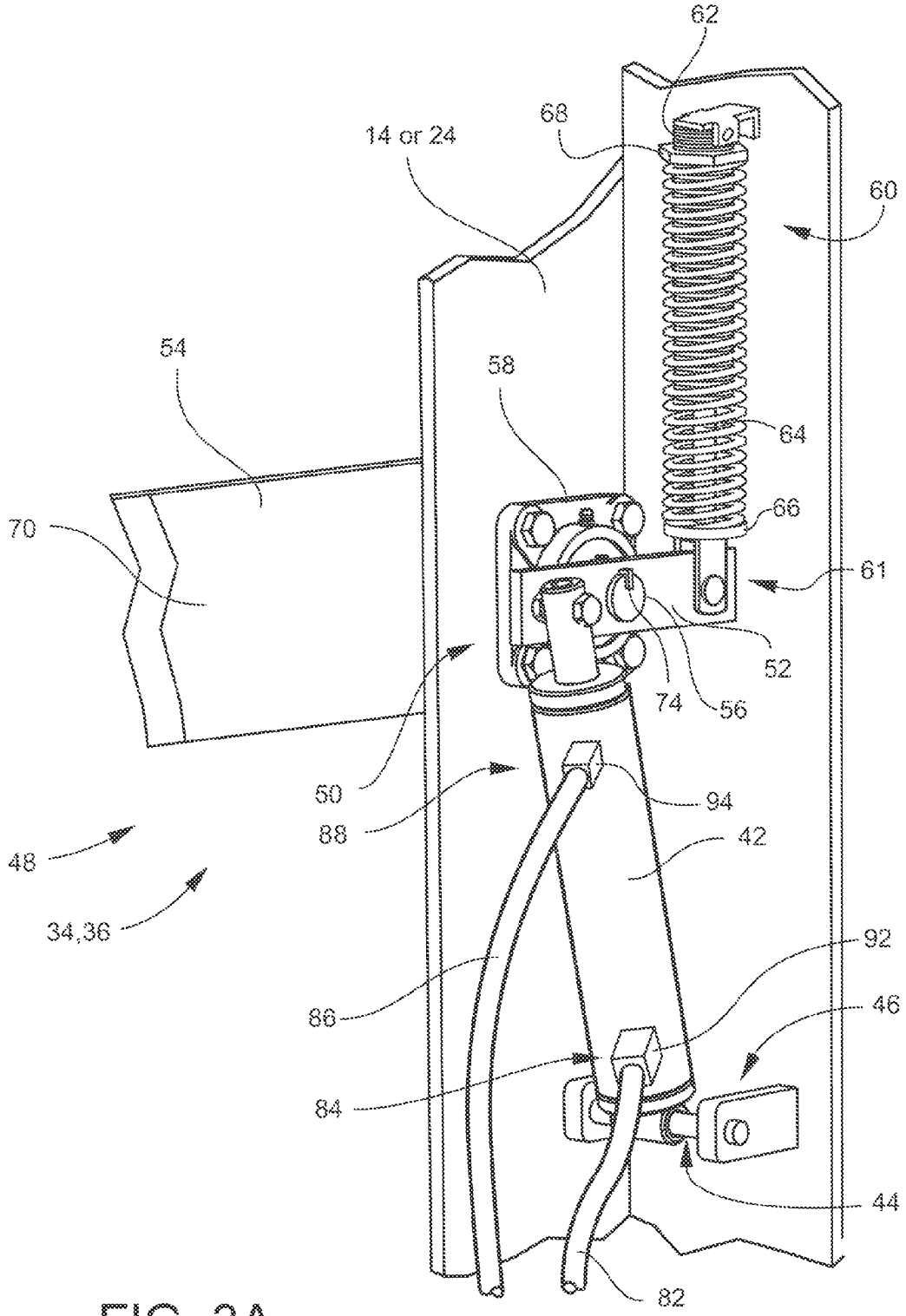
FIG. 3A is a zoomed in view of FIG. 2 in an intermediate position.
Figure 3B:
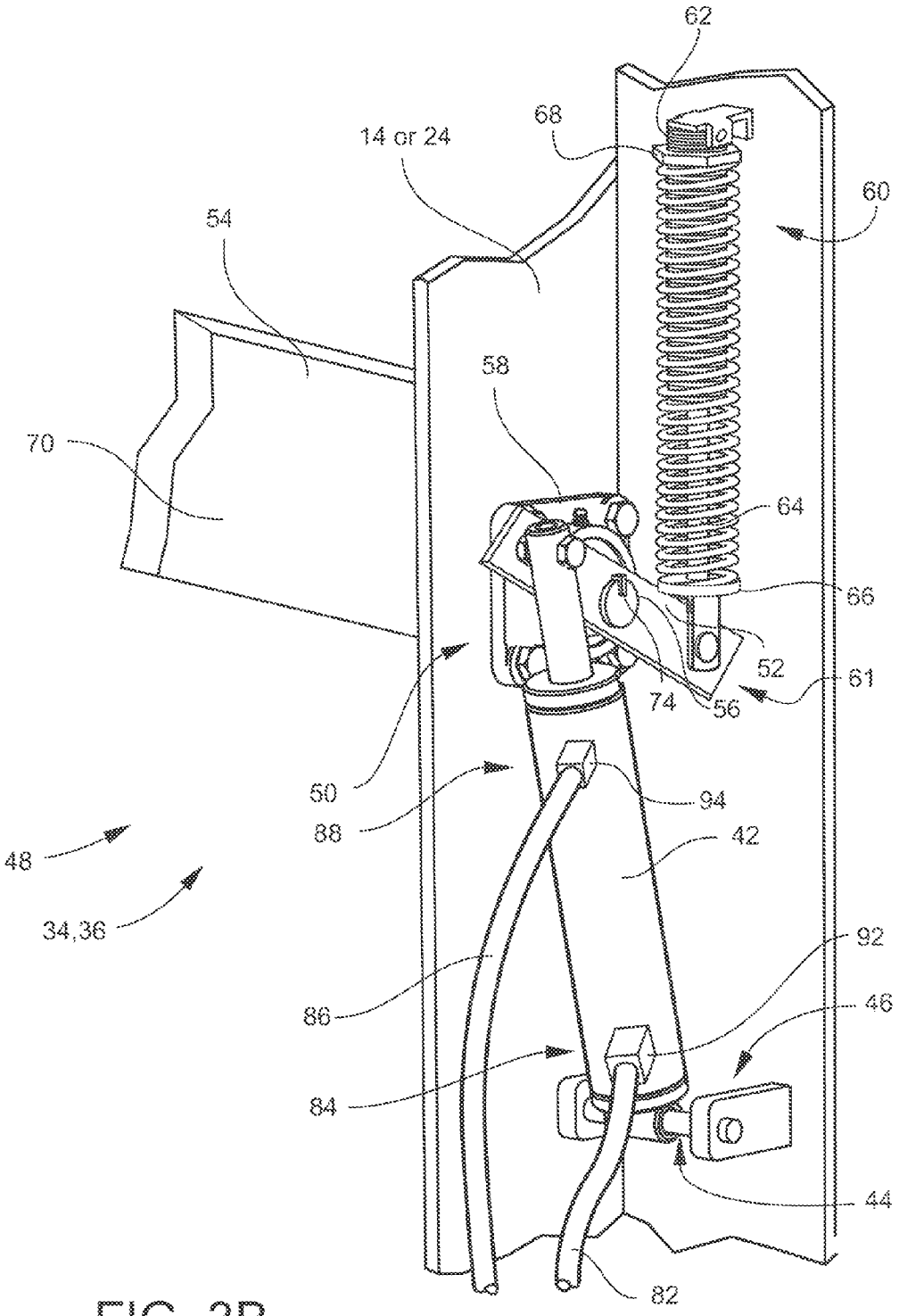
FIG. 3B is a zoomed in view of FIG. 2 in a more open position than FIG. 3A.

Referring now to the embodiments shown in FIGS. 2-3, in select embodiments, the internal operator 34 may be the hydraulic operator 36. The hydraulic operator 36 may include at least one hydraulic cylinder 42 configured to lengthen and shorten for raising and lowering the gate 12.

As shown in FIGS. 2-3, the hydraulic operator 36 may include the rotatable mount 44 and the lever assembly 48. The rotatable mount 44 may be on the fixed end 46 of the hydraulic cylinder 42. The rotatable mount 44 may allow hydraulic cylinder to rotate or pivot to allow for operation of lever assembly 48. The lever assembly 48 may be on the extendable end 50 of the hydraulic cylinder 42 and may be connected to the gate 12. The lever assembly 48 may include the first lever 52, the second lever 54, and the shaft 56. The first lever 52 may be internal to the pole along with the hydraulic cylinder 42. The shaft 56 may connect with the first lever 52 and go through the pole and communicate with the second lever 54 on the outside of the pole. The shaft 56 may be held in place by pillow block bearings 58, or any other like bearings or other similar devices for allowing shaft 56 to rotate in position. First lever 52 may be pivotally connected to the extendable end 50 of the hydraulic cylinder at one end and fixed to one end of the shaft 56, and the second lever 54 may be pivotally connected to the gate 12 at one end and fixed to the other end of the shaft 56. Whereby, rotation of the first lever 52, via the hydraulic cylinder 42 extending and shortening, may cause rotation of the second lever 54 thereby raising or lowering the gate 12.

Lift gate system 10 may be powered solely by internal operator 34. As such, internal operator 34 may be sized or provided with enough power to lift the gate 12. In select embodiments, lift gate system 10 may include a spring or plurality of springs that bias gate 12 to lift or open for aiding internal operator 34. Ideally, the spring or plurality of springs may be sized or provide enough force to bias gate 12 to lift or open to require minimal power from internal operator 34, i.e. to counterbalance the gate 12.

Referring again to FIGS. 2-3, in select embodiments, the lever assembly 48 may include the compression spring 60. The compression spring 60 may be for biasing gate 12 to lift or open and for aiding internal operator 34, thereby reducing the size or power required by internal operator 34. Ideally, compression spring 60 may be sized or provide enough force to counterbalance gate 12 to lift or open to require minimal power from internal operator 34. Compression spring 60 may be mounted on the lengthened end 61 of the first lever 52 opposite the extendable end 50 of the hydraulic cylinder 42. The compression spring 60 may bias the first lever 52 to put an upward force on the gate 12 via the second lever 54 and the shaft 56.

In select embodiments, the compression spring 60 may be adjustable. Compression spring 60 may be adjustable by any means. In one embodiment, as shown in FIGS. 2-3, the compression spring 60 can be adjustable by including the threaded shock absorber body 62, the shock absorber rod 64 and the compression nut 68. The threaded shock absorber body 62 may be pivotally mounted at its fixed end, similar to the rotatable mount 44 for hydraulic cylinder 42. The shock absorber rod 64 may extend from the threaded shock absorber body 62 and may terminate at the spring site 66. The compression nut 68 may be on the shock absorber body 62 for adjusting the force of the compression spring 60 on the first lever 52 via the spring site 66. For example, as the compression nut 68 is turned clockwise (or vice versa), the distance between the compression nut 68 and spring site 66 shortens, thereby increasing the force applied on first lever 52 by compression spring 60. Likewise, as the compression nut 68 is turned counter clockwise (or vice versa), the distance between the compression nut 68 and spring site 66 lengthens, thereby decreasing the force applied on first lever 52 by compression spring 60. Compression spring 60 may hold tension on the first lever 52 that is inside the gate post in such a way to put an upward force on the second lever 54 that is attached to the gate 12 outside the post. The compression spring 60 can be manipulated by the threaded compression nut 68 in such a way to increase tension or decrease tension enabling the weight of the gate 12 to be counterbalanced. In select embodiments, the compression spring 60 and a bypass lever on the hydraulic pump may allow the gate to be opened and closed manually. As examples, and clearly not limited thereto, the overall length of compression spring 60 and body 62 with rod 64 may be 12 inches and the outside diameter of the spring 60 may be 2½ inches, where the hydraulic cylinder 42 retracted diminution may be 12 inches and the outside diameter may be 1½ inches. As another example, manual over ride springs may be included inside the gate posts. There may be two manual override springs in each post, with one spring above the lever and one spring below the lever. In this two spring embodiment, the springs may aid in helping the operator open the gates and close the gates and may also allow for unpinning of the base mount of the cylinders to allow opening gate manually.

Figure 4:
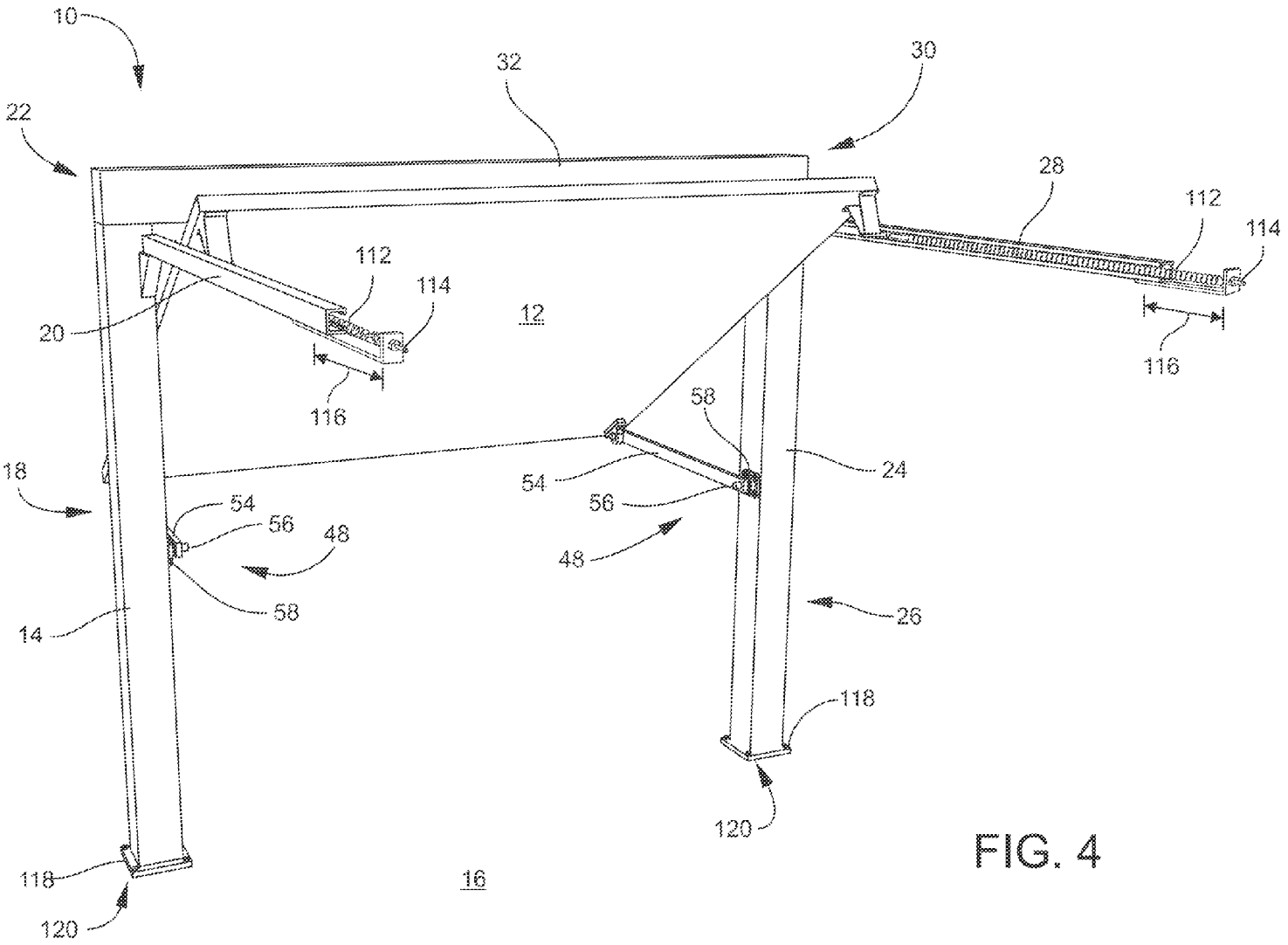
FIG. 4 is a perspective view of another exemplary embodiment of the lift gate system in an intermediate position with tension springs in each track.
Figure 6:
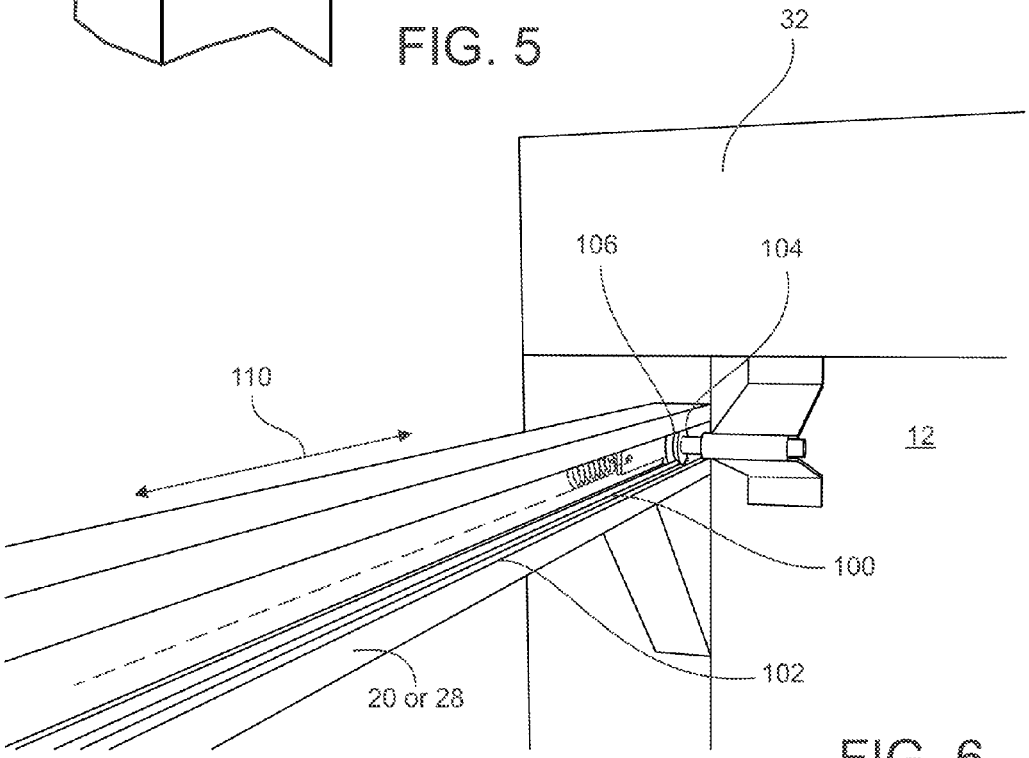
FIG. 6 is a perspective view of another exemplary embodiment of one of the tracks.

Referring now to FIGS. 4 and 6, in select embodiments lift gate system 10 may include the tension springs 112 in the first track 20 and/or second track 28. Tension springs 112 may be for biasing gate 12 to lift or open and for aiding internal operator 34, thereby reducing the size or power required by internal operator 34. Ideally, tension springs 112 may be sized or provide enough force to counterbalance gate 12 to lift or open to require minimal power from internal operator 34. Tension springs 112 may be used alone for biasing gate 12 to lift or open or may be used in combination with compression spring 60. Likewise, compression spring 60 may be used alone for biasing gate 12 to lift or open or may be used in combination with tension springs 112. Tension springs 112 may be adjustable by any means or device. In select embodiments, each tension spring 112 may include the adjustment bolt 114 for adjusting the distance 116 from the terminal end of each track 20 and 28 thereby adjusting the tension in each tension spring 112.

Lift gate system 10 may include many features for disengaging internal operator 34 for manual operation. One feature may be that the second lever 54 can include an angle iron 70 releasably connected to a flat bar 72 pivotally attached to the gate. This feature may allow the angle iron 70 to be disconnected from the flat bar 72 for manually operating the gate. Another feature may be that the shaft can be keyed or have keyed attachments 74 at one or both ends for disengaging the first lever 52 and/or the second lever 54 from the shaft for manually operating the gate.

The hydraulic operator 36 may include any desired hydraulic setup for operating gate 12. Referring to FIGS. 2-3, in select embodiments the hydraulic operator 36 may include the fluid reservoir 76 and the pump 78. The pump 78 may interconnect with the fluid reservoir 76 and the hydraulic cylinder 42 and may control fluid moving between the fluid reservoir 76 and the hydraulic cylinder 42 for lengthening and shortening the hydraulic cylinder 42. An intake line 80 may be included for interconnecting the reservoir 76 with the pump 78. The pressure line 82 may be included for interconnecting the inlet 84 of the hydraulic cylinder 42 with the fluid pump 78. The return line 86 may be included for interconnecting the outlet 88 of the hydraulic cylinder 42 with the reservoir 76. In select embodiments, the four way valve 90 may be included between the pressure line 82 and the return line 86 for controlling the direction of flow. In select embodiments, the inlet two way check valve 92 may be included at the inlet 84 of the hydraulic cylinder 42, and/or the outlet two way check valve 94 may be included at the outlet 88 of the hydraulic cylinder 42. These two way check valves 92 and 94 may be used for controlling the flow to and from hydraulic cylinder 42, like for stopping movement of gate 12. In select embodiments, the fluid pump 78 may include a neutral position, including any buttons or levers that put the pump 78 into a neutral position. The neutral position may relieve pressure in pump 78 and allow free movement of fluid to and from the pump 78 for manual operation of gate 12. For example, if any tension and/or compression springs are included with system 10, pump 78 may be put into neutral for allowing a user to lift gate 12 manually. In select embodiments, the compression springs and/or tension springs may be strong enough to lift gate 12 when pump 78 is in neutral or system 10 is put into manual operation by any other means (like keyed attachments 74, the angle iron of second lever 54, etc.).

In select embodiments, the pump 78, reservoir 76 and/or any other components for powering the hydraulic cylinder 42 of the internal operator 34 may be included in any of the components of system 10, including, but not limited to, in the first post 14, the second post 24, and/or the header 32. In other select embodiments, the pump 78, reservoir 76 and/or any other components for powering the hydraulic cylinder 42 of the internal operator 34 may be included in the same component of system 10 as hydraulic cylinder 42, like first post 14 and/or second post 24, or it may be included in a separate component of system 10, like the opposite post (14 or 24) and/or header 32. In addition, in other select embodiments, pump 778, reservoir 76 and/or any other components for powering the hydraulic cylinder 42 of the internal operator 34 may be included outside of the components of system 10, like in a remote location next to system 10 (wall, ceiling, underground, etc.).

The hydraulic operator 36 may have two hydraulic cylinders 42. In these embodiments, the pressure flow divider 96 may be included in the pressure line 82 for connecting the second inlet 84 of the second hydraulic cylinder 42, and the return flow divider 98 may be included in the return line 86 for connecting the second outlet 88 of the second hydraulic cylinder 42. The pressure line 82 and return line 86 may be run from the pressure flow divider 96 and return flow divider 98 from one post to the other, like through header 32. Wherein, the first hydraulic cylinder 42 may be in the first post 14 and the second hydraulic cylinder 42 may be in the second post 24, or vice versa. In select embodiments, a single hydraulic operator 36 may be included for operating one or more gates. For example, hydraulic operator 36 may be positioned in left or right post 14 or 24 and may operate the gate 12 between them. In another example, hydraulic operator 36 may be positioned in the center post between two gates 12 for operating both gates.

Figure 5:
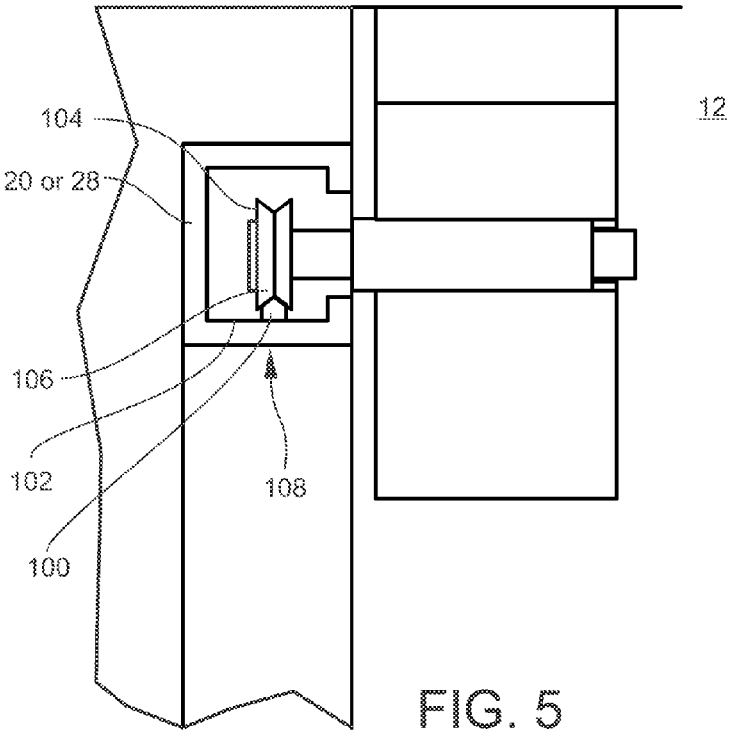
FIG. 5 is a cross-sectional view of an exemplary embodiment of one of the tracks.

Referring now to FIGS. 5-6, another feature of the lift gate system 10 may be that each of the first and second tracks 20 and 28 can include the protrusion 100 from the bottom 102 of each of the tracks along the entire length 110 of each track. The guide wheel 104 for each track may have the notch 106 adapted to receive the protrusion 100. Whereby, the protrusion 100 may maintain the guide wheel 104 in the center 108 of the track as the guide wheel 104 rides along the length 110 of the track over the protrusion 100. This setup of the first and second tracks 20 and 28 with protrusions 100 and guide wheels 104 with notches 106, may allow for efficient operation, less noise, and/or prolonged part life. In one embodiment, as shown in FIGS. 5-6, the protrusions 100 may have a V-shaped top and the guide wheels 104 may have a corresponding V-shaped notch.

Referring again to FIGS. 1 and 4, another feature of lift gate system 10 may be that each of the first and second poles 14 and 24 (and center pole, if included) may include flanges 118 at their bottoms adapted to attach each pole to an anchor 120 in the ground 16. The anchors 120 may be installed in the ground 16 at the desired location for each pole 14 and 24. Once the anchors 120 are installed, to install lift gate system 10, all one needs to do is attach flanges 118 of the first and second poles 14 and 24 to their respective anchor 120, like with bolts or the like. For example, and clearly not limited thereto, as shown in FIGS. 1 and 4, anchors 120 may have 4 bolts and flanges 118 may have 4 holes sized and positioned to receive the 4 bolts from anchors 120. This feature allows for quick and easy installation of lift gate system 10 with minimal blocking of the entrance/exit. Because first and second tracks 20 and 28 are attached to first top 22 and second top 30, respectively, and header 32 connects to first top 22 and second top 30, first and second tracks 20 and 28 may be pre-aligned with lift gate system 10. First and second tracks 20 and 28 may be attached to the first top 22 and second top 30 by any fixed means, including any brackets, bolts, etc. for maintaining the tracks at a fixed relationship to their respective poles.

Figure 7:
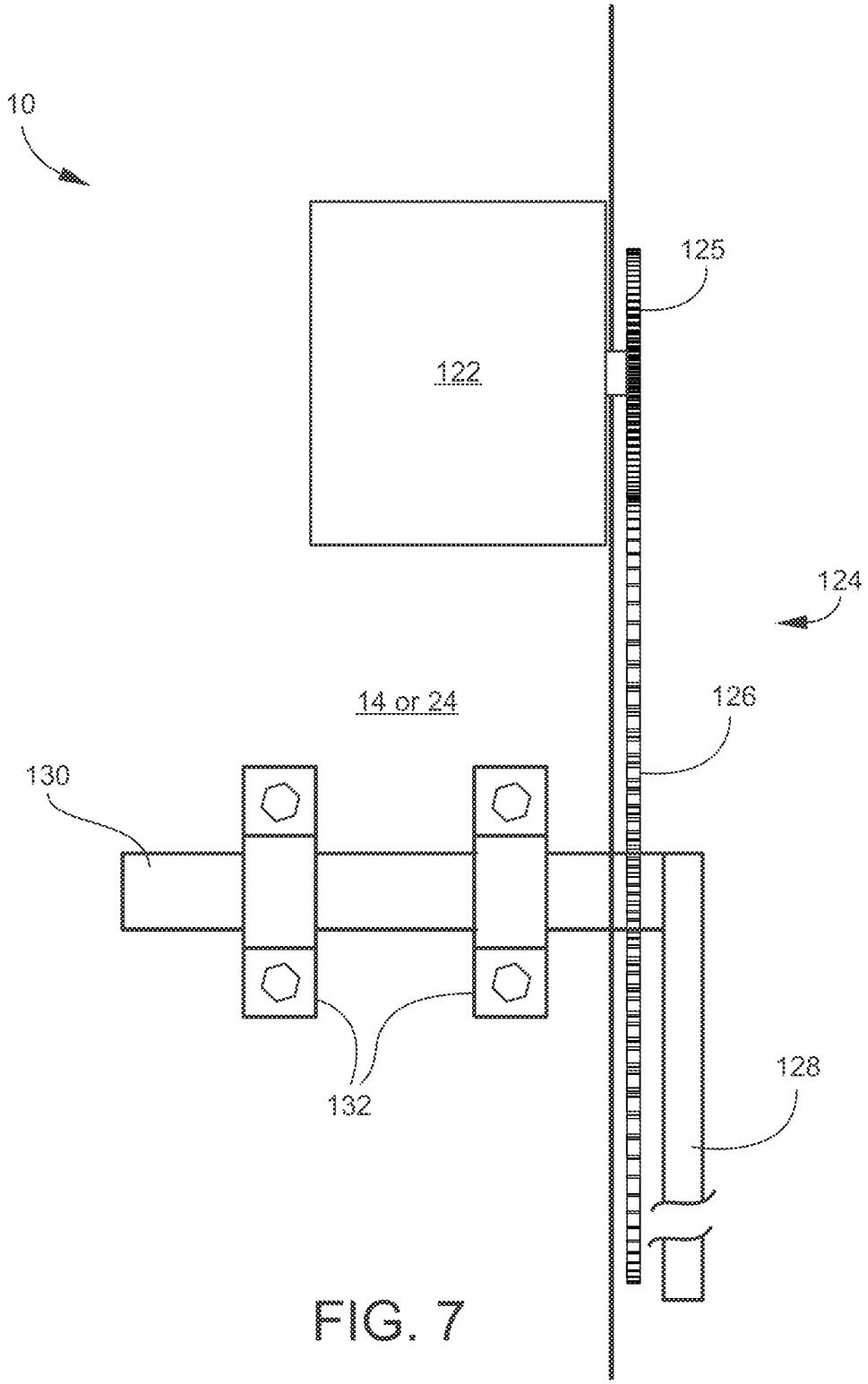
FIG. 7 is a partial broken away side view of an exemplary embodiment of one of the posts with an exemplary embodiment of the gear assembly.

Referring now to FIG. 7, in select embodiments of the lift gate system 10, the internal operator 34 may include the motor 122 and the gear assembly 124. The gear assembly 124 may be linked to the motor 122 and connected to the gate 12. The gear assembly 124 may include the motor gear 125, the idle gear 126, and the gate arm 128. The motor gear 125 may be outside the post and may connect to the motor 122 through the posts (14 or 24). The idle gear 126 may be in communication with the motor gear 125 and may have the idle shaft 130. The idle shaft 130 may be held in place with pillow block bearings 132, or other like bearings or similar devices for allowing idle shaft 130 to rotate in place. The gate arm 128 may be connected to the idle shaft 130 on one end and the gate 12 on the other end. Whereby, rotation of the motor 122 turns the gear assembly 124 for raising and lowering the gate 12. Motor 122 may be any desired motor capable of raising and lowering gate 12. In select embodiments, the motor 122 may be a hydraulic motor.

Referring now to FIG. 8, in select embodiments of the lift gate system 10, the hydraulic operator 36 may include the fixed mount 134 with the slot assembly 136. The fixed mount 134 may be on the fixed end 46 of the hydraulic cylinder 42. The slot assembly 136 may be on the extendable end 50 of the hydraulic cylinder 42 and may be connected to the gate 12. The slot assembly 136 may include the pivot shaft 138 on the extendable end 50 of the hydraulic cylinder 42 going through the slot 140 in the pole and connecting with the gate 12 by the pillow block bearing 142, or other like devices. Wherein, because the gate 12 is being lifted with a straight vertical force (no rotating gate arm) the first and second tracks 20 and 28 may include the first angled portion 144 for initiating the raising of the gate 12. Whereby, raising and lowering of the extendable end 50 of the hydraulic cylinder 42 may cause raising or lowering of the gate 12.

System 10 may include any electronics and electronic features for operating gate 12 or multiple gates 12 via internal operator 34. In select embodiments the electronics may be monitored on computers for providing feedback to the system 10, including, but not limited to, providing feedback on leaks in lines, etc., providing feedback on tension or compression springs getting weak and needing adjustment, the like, etc.

Figure 9:
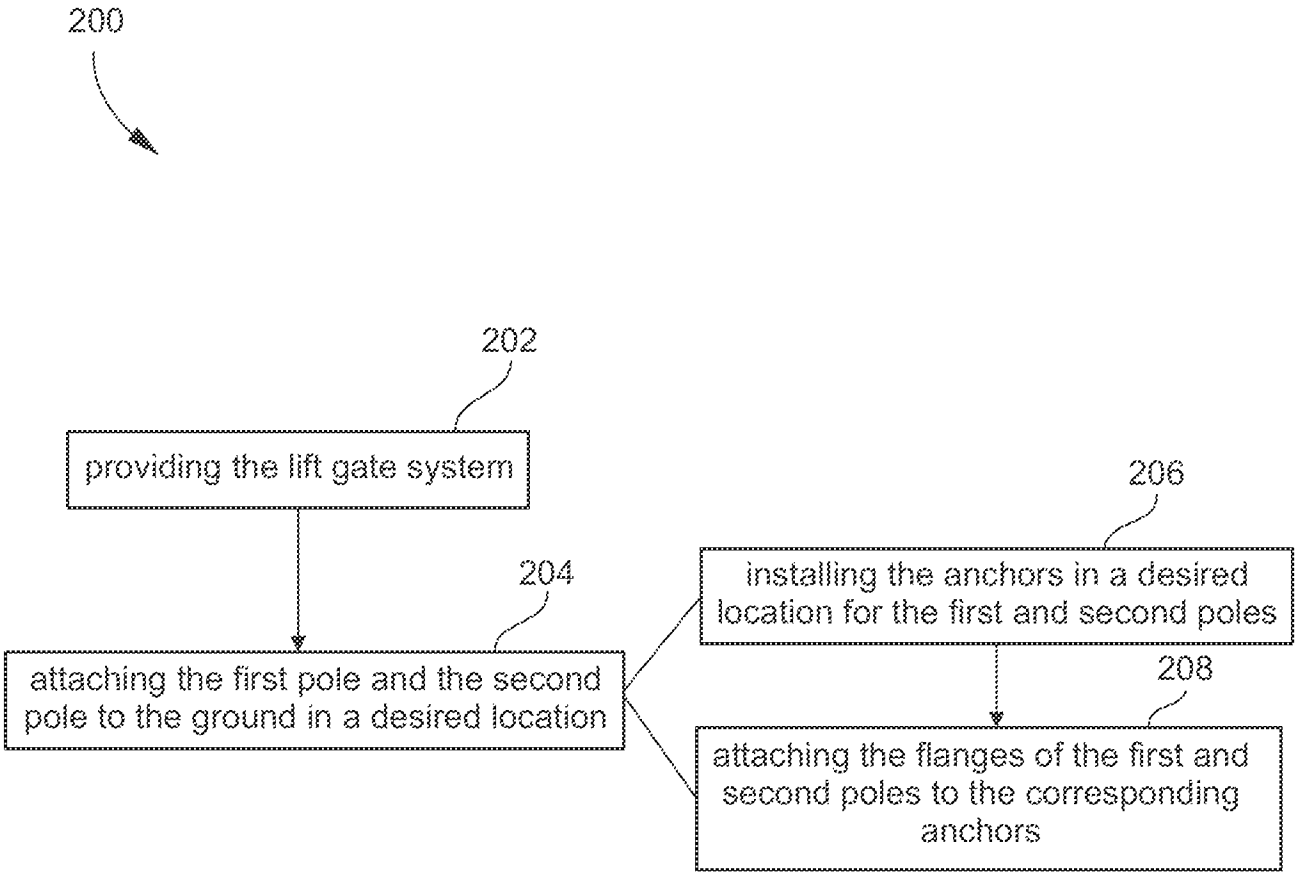
FIG. 9 is a flow diagram of an exemplary embodiment of the method of installing a gate system.

Referring now to FIG. 9, in use, the method 200 of installing the lift gate system 10 may be carried out with any of the embodiments of the lift gate system 10 shown and/or described herein. In general the method 200 of installing the lift gate system 10 may include the steps of: the step 202 of providing the lift gate system 10 in any of the various embodiments shown and/or described herein; and the step 204 of attaching the first pole 14 and the second pole 24 to the ground 16 in a desired location.

In select embodiments of the method 200 of installing the lift gate system 10, where the first and second poles 14 and 24 include the flanges 118 adapted to attach each pole to the anchor 120 in the ground, the step 204 of attaching the first pole 14 and the second pole 24 to the ground 16 in a desired location may include the steps of: the step 206 of installing the anchors 120 in a desired location for the first and second poles 14 and 24; and the step 208 of attaching the flanges of the first and second poles 14 and 24 to the corresponding anchors 120.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A lift gate system comprising:

a gate;

a first pole configured to attach to a ground surface on one side of the gate including a first track attached approximate to a first top;

a second pole configured to attach to the ground surface on an opposite side of the gate from the first pole including a second track attached approximate to a second top;

a header interconnecting the first top with the second top; and an internal operator configured for lifting the gate, where said internal operator being inside one of said first pole, and said second pole;

wherein said internal operator being a hydraulic operator including:

at least one hydraulic cylinder configured to lengthen and shorten for raising and lowering the gate;

wherein said hydraulic operator further including:

a rotatable mount on a fixed end of the at least one hydraulic cylinder; and a lever assembly on an extendable end of the at least one hydraulic cylinder connected to said gate, said lever assembly including:

a first lever;

a second lever; and a shaft held in place by pillow block bearings;

wherein, said first lever being pivotally connected to said extendable end of the at least one hydraulic cylinder at one end and fixed to one end of said shaft, and said second lever being pivotally connected to said gate at one end and fixed to the other end of said shaft;

whereby, rotation of said first lever by said hydraulic cylinder causes rotation of said second lever thereby raising or lowering the gate.

2. The lift gate system of claim 1, wherein said lever assembly further comprising a compression spring mounted on a lengthened end of said first lever opposite said extendable end of the at least one hydraulic cylinder;

said compression spring biasing said first lever to put an upward force on the gate via said second lever and said shaft.

3. The lift gate system of claim 2, wherein said compression spring including:

a threaded shock absorber body pivotally mounted;

a shock absorber rod extending from said shock absorber body and terminating at a spring site; and a compression nut on said shock absorber body for adjusting a force of said compression spring on said first lever via said spring site.

4. The lift gate system of claim 1, wherein said lever assembly further including:

the second lever includes an angle iron releasably connected to a flat bar pivotally attached to the gate, wherein said angle iron may be disconnected from the flat bar for manually operating the gate.

5. The lift gate system of claim 1, wherein said lever assembly further including:

said shaft is keyed at both ends for disengaging one of the first lever, the second lever, and combinations thereof, from the shaft for manually operating the gate.

6. The lift gate system of claim 1, wherein said hydraulic operator further including:

a fluid reservoir;

a pump interconnected with said fluid reservoir and said at least one hydraulic cylinder that controls fluid moving between said fluid reservoir and said at least one hydraulic cylinder for lengthening and shortening the at least one hydraulic cylinder;

an intake line interconnecting said reservoir with said pump;

a pressure line interconnecting an inlet of said at least one hydraulic cylinder with said fluid pump; and a return line interconnecting an outlet of said at least one hydraulic cylinder with said reservoir.

7. The lift gate system of claim 6, wherein said hydraulic operator further including:

a four way valve between said pressure line and said return line for controlling flow;

an inlet two way check valve at the inlet of said at least one hydraulic cylinder; and an outlet two way check valve at the outlet of said at least one hydraulic cylinder.

8. The lift gate system of claim 6, wherein said hydraulic operator having two hydraulic cylinders and further including:

a pressure flow divider in said pressure line for connecting a second inlet of the second hydraulic cylinder; and a return flow divider in said return line for connecting a second outlet of the second hydraulic cylinder;

wherein the first hydraulic cylinder is in the first post and the second hydraulic cylinder is in the second post.

9. The lift gate system of claim 1 wherein each of said first and second tracks including:

a protrusion from a bottom of each of the tracks along a length of each track;

a guide wheel for each track having a notch adapted to receive the protrusion;

whereby the protrusion maintaining the wheel in a center of the track as the wheel rides along the length of the track over the protrusion.

10. The lift gate system of claim 1, wherein each of said first and second tracks including a tension spring configured to bias said gate open, where each tension spring includes an adjustment bolt for adjusting a distance from a terminal end of each track thereby adjusting a tension in each spring.

11. The lift gate system of claim 1, wherein each of said first and second poles including a flange adapted to attach each pole to an anchor in the ground surface.

12. The lift gate system of 1, wherein said internal operator including:

a motor; and a gear assembly linked to said motor and connected to said gate;

said gear assembly including:

a motor gear connected to said motor;

an idle gear in communication with said motor gear and having an idle shaft held in place with pillow block bearings; and a gate arm connected to said idle shaft on one end and said gate on the other end;

whereby, rotation of said motor turns said gear assembly for raising and lowering the gate.

13. The lift gate system of claim 4, wherein said hydraulic operator further including:

a fixed mount on a fixed end of the at least one hydraulic cylinder; and a slot assembly on an extendable end of the at least one hydraulic cylinder connected to said gate;

said slot assembly including:

a pivot shaft on the extendable end of the at least one hydraulic cylinder going through a slot in the pole and connecting with the gate by a pillow block bearing;

wherein, the first and second tracks include a first angled portion for initiating the raising of the gate;

whereby, raising and lowering of the extendable end of said at least one hydraulic cylinder causes raising or lowering of the gate.

14. A lift gate system comprising:

a gate;

a first pole configured to attach to a ground surface on one side of the gate including a first track attached approximate to a first top;

a second pole configured to attach to the ground surface on an opposite side of the gate from the first pole including a second track attached approximate to a second top;

a header interconnecting the first top with the second top; and an internal operator configured for lifting the gate, where said internal operator being inside one of said first pole, and said second pole;

wherein said internal operator being a hydraulic operator including:

at least one hydraulic cylinder configured to lengthen and shorten for raising and lowering the gate;

wherein said hydraulic operator further including:

a fluid reservoir;

a pump interconnected with said fluid reservoir and said at least one hydraulic cylinder that controls fluid moving between said fluid reservoir and said at least one hydraulic cylinder for lengthening and shortening the at least one hydraulic cylinder;

an intake line interconnecting said reservoir with said pump;

a pressure line interconnecting an inlet of said at least one hydraulic cylinder with said fluid pump; and a return line interconnecting an outlet of said at least one hydraulic cylinder with said reservoir.

15. A lift gate system comprising:

a gate;

a first pole configured to attach to a ground surface on one side of the gate including a first track attached approximate to a first top;

a second pole configured to attach to the ground surface on an opposite side of the gate from the first pole including a second track attached approximate to a second top;

a header interconnecting the first top with the second top; and an internal operator configured for lifting the gate, where said internal operator being inside one of said first pole, and said second pole;

wherein said internal operator including:

a motor; and a gear assembly linked to said motor and connected to said gate;

said gear assembly including:

a motor gear connected to said motor;

an idle gear in communication with said motor gear and having an idle shaft held in place with pillow block bearings; and a gate arm connected to said idle shaft on one end and said gate on the other end;

whereby, rotation of said motor turns said gear assembly for raising and lowering the gate.

* * * * *